US005786659A

United States Patent [19]

Takagi et al.

[11] Patent Number: 5,786,659

[45] Date of Patent: *Jul. 28, 1998

[54] FIELD EMISSION TYPE ELECTRON SOURCE

[75] Inventors: Toshinori Takagi, Nagaokakyo; Masateru Taniguchi, Mobara; Shigeo Itoh, Mobara; Teruo Watanabe, Mobara; Takahiro Niiyama, Mobara, all of Japan

[73] Assignee: Futaba Denshi Kogyo K.K., Mobara, Japan

[ * ] Notice: The term of this patent shall not extend beyond the expiration date of Pat. No. 5,650,689.

[21] Appl. No.: 350,027

[22] Filed: Nov. 29, 1994

[30] Foreign Application Priority Data

Nov. 29, 1993 [JP] Japan ..... 5-320923
Dec. 22, 1993 [JP] Japan ..... 5-345609

[51] Int. Cl.[6] ..... H01J 1/16

[52] U.S. Cl. ..... 313/309; 313/336; 313/351; 313/310; 313/495

[58] Field of Search ..... 313/309, 336, 313/351, 310, 495; 315/169.4

[56] References Cited

U.S. PATENT DOCUMENTS 3,755,704 8/1973 Spindt et al. ..... 313/336 X
5,142,184 8/1992 Kane ..... 313/309
5,189,341 2/1993 Itoh et al. ..... 313/309 X
5,194,780 3/1993 Meyer ..... 313/309 X

*Primary Examiner*—Ashok Patel
*Attorney, Agent, or Firm*—Oblon, Spivak, McClelland, Maier & Neustadt, P.C.

[57] ABSTRACT

A field emission type electron source capable of permitting a resistance value between a cathode wiring and each of emitter cones to be set at substantially the same level and increasing packaging density of the emitter cones. The electron source includes stripe-like cathode wirings arranged on an insulating substrate. The cathode wirings each are formed with a plurality of windows, so that a plurality of island-like cathode conductors and resistance layers different in resistance value from each other are formed separate from the cathode wiring. Then, a resistance layer, an insulating layer and a gate electrode are formed thereon. The gate electrode and insulating layer are formed with apertures in a manner to be common to both, in which the emitter cones are arranged, resulting in emission of electrons from the emitter cones of each group unit being rendered uniform.

14 Claims, 14 Drawing Sheets

FIELD EMISSION TYPE ELECTRON SOURCE

BACKGROUND OF THE INVENTION

This Invention relates to a field emission type electron source, and more particularly to an improvement in a field emission type electron source known as a cold cathode.

Application of an electric field as high as $10^9$ (V/m) to a surface of a metal material or that of a semiconductor material results in a tunnel effect, which permits electrons to pass through a barrier, so that the electrons may be discharged to a vacuum even at a normal temperature. This is referred to as "field emission" and a cathode constructed so as to emit electrons based on such a principle is referred to as "field emission cathode" (hereinafter also referred to as "FEC").

Recent remarkable progress of semiconductor processing techniques permits formation of an FEC as small as microns. A Spindt-type FEC is known as a typical example of such a field emission cathode. Manufacturing of the Spindt-type FEC by semiconductor fine processing techniques permits a distance between each of conical emitters or emitter cones and a gate electrode to be submicrons or less than a micron, so that application of a voltage of tens of volts between the emitter cone and the gate electrode results in the emitter cone emitting electrons.

Also, a pitch between the emitter cones can be set to be 5 to 10 microns, so that ten thousands to hundred thousands of FECs may be arranged on a single substrate.

Thus, manufacturing of a surface-emission type PEC is possible and it is proposed to apply the PEC to a field emission type electron source for a fluorescent display device, CRT, an electron microscope, an electron beam apparatus or the like.

Now, such an FEC used as the field emission type electron source will be described with reference to FIGS. 25(*a*) and 25(*b*), wherein FIG. 25(*a*) is a plan view of the FEC and FIG. 25(*b*) is a sectional view taken along line G—G of FIG. 25(*a*).

As shown in FIG. 25(*a*), a cathode wiring 102 is formed into a lattice-like pattern and a resistance layer 103 is formed all over the lattice-like cathode wiring 102. The resistance layer 103 is formed on a portion thereof surrounded by each of lattices defined by the cathode wiring 102 with a plurality of emitter cones 106. Also the field emission type electron source shown in FIG. 25(*a*) includes a gate electrode 105 arranged so as to form an upper surface section of the source. The gate electrode 105 is formed with a plurality of through-holes or apertures of a substantially circular shape. The emitter cones 106 are located in the apertures, respectively.

As will be noted from FIG. 25(*b*), the lattice-like cathode wiring 102 is formed on an insulating substrate 101, on which the resistance layer 103 is formed so as to cover the whole substrate 101. The resistance layer 103 is formed thereon with an insulating layer 104 and the gate electrode 105 in turn. The above-described apertures are formed through both gate electrode 105 and insulating layer 104 and the emitter cones 106 are arranged in the apertures.

Now, reasons why the resistance layer 103 is arranged between the emitter cones 106 and the cathode wiring 102 will be described hereinafter.

An FEC is typically constructed in such a manner that a distance between a distal end of each of emitter cones and a gate is set to be as small as submicrons and ten thousands to hundred thousands of emitter cones are arranged on a single substrate, resulting in short-circuiting often occurring between the emitter cone and the gate due to dust or the like during manufacturing of the FEC. Even when the short-circuiting is caused by only one of the emitter cones, it causes short-circuiting to occur between the cathode and the gate, so that a failure in application of a voltage extends over all the emitter cones. Thus, the FEC fails to function as a field emission type electron source.

Also, the conventional field emission type electron source often causes local degassing, resulting in discharge often occurring between the emitter cone and the gate or an anode. This causes a large current to flow through the cathode, leading to breakage of the cathode.

Of a number of emitter cones, certain emitter cones are apt to easily emit electrons as compared with the remaining ones, so that electrons concentratedly emitted from the certain emitter cones leads to formation of abnormally bright spots on an image plane.

In order to solve the problem, as shown in FIGS. 25(*a*) and 25(*b*), the resistance layer 103 is arranged between the cathode wiring 102 and the emitter cones 106, so that the resistance layer causes drop in voltage between the gate electrode 105 and the cathode wiring 102 when one of the emitter cones 106 starts to emit an excessive amount of electrons due to non-uniformity in shape. The drop in voltage causes a voltage applied to the emitter cone excessively emitting electrons to be reduced depending on a discharge current, so that emission of electrons therefrom is restrained, resulting in the emitter cones each uniformly or stably emitting electrons. This prevents breakage of the cathode wiring 102.

Thus, arrangement of the resistance layer 103 improves yields of the FEC manufactured and ensures stable operation of the FEC.

Nevertheless, when the FEC of FIGS. 25(*a*) and 25(*b*) is so constructed that a region surrounded or defined by each of lattices of the cathode wiring 102 is increased in area and the emitter cones 106 are arranged all over the region, a resistance value between the cathode wiring 102 and each of the emitter cones 106 is varied depending on a distance between the cathode wiring 102 and the emitter cone 106. More particularly, emitter cones 106 arranged in proximity to the cathode wiring 106 each exhibit a reduced resistance value, whereas emitter cones 106 arranged in proximity to a central portion of the region each are increased in resistance value with a decrease in distance between the emitter cone and the central portion of the region. This causes emission of electrons from the emitter cones arranged in proximity to a periphery of the cathode wiring 102 to be kept at a high level but that from the emitter cones arranged near the central portion of the region to be decreased with a decrease in distance between the emitter cones and the central portion.

In view of such a problem, the conventional FEC, as shown in FIGS. 25(*a*) and 25(*b*), is so constructed that arrangement of the emitter cones in the region defined by each of the lattices is carried out while keeping the emitter cones spaced by a predetermined distance from the periphery of the cathode wiring 102, to thereby neglectedly reduce deviation in resistance value between the lattice-like cathode wiring 102 and each of the emitter cones, resulting in increasing in uniformity of emission of electrons from the emitter cones. Unfortunately, such construction fails to arrange the emitter cones in a portion of the region between the periphery of the cathode wiring and a position spaced by the distance L therefrom, to thereby decrease packaging density of the emitter cones or density at which the emitter cones are mounted on the region.

Also, in order to render a resistance value between the cathode wiring and each of the emitter cones uniform, it would be considered to divide the cathode wiring to a degree sufficient to permit about four such emitter cones to be arranged in each of the lattices defined by the lattice-like cathode wiring. However, this causes packing density of the emitter cones to be reduced.

Further, a position of each of the emitter cones 106 with respect to the lattice-like cathode wiring 102 affects a resistance value of the emitter cones, so that the resistance value is caused to be varied depending on accuracy with which alignment of the emitter cones is carried out during manufacturing of the FEC. Thus, it is required to accurately carry out mask alignment in order to arrange the emitter cones 106 with respect to the cathode wiring with high accuracy, resulting in rendering manufacturing of the FEC troublesome and difficult.

In addition, in place of the construction shown in FIGS. 25(*a*) and 25(*b*), the conventional FEC may be constructed in such a manner that a resistance layer is formed on a cathode wiring of a stripe-like shape rather than a lattice-like shape so as to fully cover the cathode wirings, followed by arrangement of emitter cones on the resistance layer thus formed on the cathode wirings, as conventionally known in the art. Unfortunately, such construction causes a resistance value of the emitter cones to be varied depending on a degree of uniformity of a film thickness of the resistance layer, to thereby fail to render emission of electrons from the emitter cones uniform. Also, the resistance value is determined depending on a thickness of the resistance layer. The thickness is limited within a predetermined range, so that it is difficult to provide the FEC with a large current capacity and permit it to exhibit a high resistance value, to thereby reduce an advantage of the resistance layer.

SUMMARY OF THE INVENTION

The present invention has been made in view of the foregoing disadvantages of the prior art.

Accordingly, it is an object of the present invention to provide a field emission type electron source which is capable of rendering a resistance value between a cathode wiring and each of emitter cones substantially constant and increasing packaging density of the emitter cones.

In accordance with the present invention, a field emission type electron source is provided. The field emission type electron source includes cathode wirings each including a region, a resistance layer arranged in correspondence to each of the cathode wirings, and emitters connected through the resistance layer to each of the cathode wirings. Connection between the cathode wiring and the emitters is carried out so as to render a resistance value therebetween substantially constant.

In a preferred embodiment of the present invention, the electron source further includes a plurality of cathode conductors in the region of the cathode wiring in a manner to be separate from the cathode wiring, wherein the cathode wiring and cathode conductors are electrically connected to each other through the resistance layer and the emitters are formed into a conical shape and arranged directly or through the resistance layer on the cathode conductors.

In a preferred embodiment of the present invention, the region of the cathode wiring is provided with conductor-free windows, in which resistance layers different in resistance value are arranged. Also, a plurality of the emitter cones are arranged on the resistance layers. The resistance layer is so constructed that a portion thereof in proximity to the cathode wiring is decreased in resistance value.

Thus, the present invention permits a resistance value between the cathode wiring and each of the emitter cones to be set at substantially the same level and packaging density of the emitter cones to be increased.

BRIEF DESCRIPTION OF THE DRAWINGS

These and other objects and many of the attendant advantage of the present invention will be readily appreciated as the same becomes better understood by reference to the following detailed description when considered in connection with the accompanying drawings; wherein:

FIG. 25(*b*) is a sectional view taken along line G—G of FIG. 25(*a*).

DETAILED DESCRIPTION OF THE PREFERRED EMBODIMENTS

Now, a field emission type electron source according to the present invention will be described hereinafter with reference to FIGS. 1 to 24.

Figure 1:
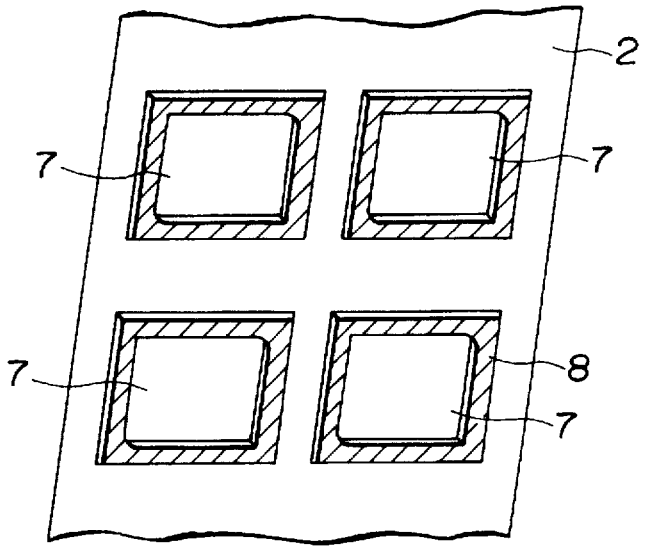
FIG. 1 is a schematic view showing a cathode electrode incorporated in a first embodiment of a field emission type electron source according to the present invention.
Figure 2:
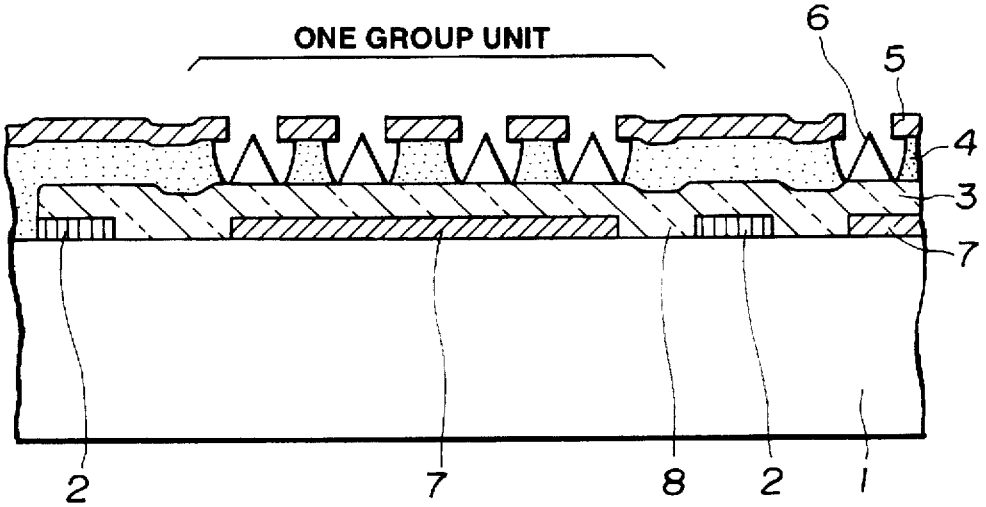
FIG. 2 is a sectional view showing a first embodiment of a field emission type electron source according to the present invention in which the cathode electrode shown in FIG. 1 is incorporated.

Referring first to FIGS. 1 and 2, a first embodiment of a field emission type electron source according to the present invention is illustrated. A field emission type electron source of the illustrated embodiment includes a cathode electrode constructed as shown in FIG. 1, which includes a plurality of stripe-like cathode wirings 2 arranged in juxtaposition to each other and each defining one region. In FIG. 1, one such cathode wiring 2 is illustrated for the sake of brevity. The cathode wiring 2 is provided with a plurality of island-like cathode conductors 7. The cathode conductors 7 each are provided with a conductor-free area in a manner to surround the cathode conductor 7, resulting in being separated from the cathode wiring through the conductor-free area 8. The conductor-free area 8 may be formed by scooping out the wiring conductor 2. The field emission type electron source of the illustrated embodiment also includes a resistance layer 3 arranged on the island cathode conductors 7 and cathode wiring 2, so that the cathode conductors 7 and cathode wiring 2 are electrically connected to each other through the resistance layer 3. The resistance layer 3 is provided on portions thereof positionally corresponding to the island-like cathode conductors 7 with emitter cones 6 functioning as an electron emitting source.

Now, the emitter cones 6 will be described with reference to FIG. 2.

As shown in FIG. 2, the cathode wiring 2 and the island-like cathode conductors 7 which are made of a conductive film of Nb, Mo, Al or the like are formed in a predetermined pattern on an insulating substrate 1. The resistance layer 3 arranged on the island-like cathode conductors 7 and cathode wiring 2 is made of amorphous silicon or the like and formed all over the region of the cathode wiring 2. Then, the resistance layer 3 is formed thereon with an insulating layer 4 made of silicon dioxide ($SiO_2$) or the like and gate electrodes 5 made of Nb, Mo, Al, $WSi_2$ or the like in order. The gate electrode 5 and insulating layer 4 are formed with through-holes in a manner to be common to both, in which the emitter cones 6 formed of Mo are arranged, respectively. The gate electrodes 5 are arranged in a stripe-like manner, to thereby form a matrix in cooperation with the cathode wirings 2.

In the illustrated embodiment, the emitter cones 6 are arranged in four rows in correspondence to each one of the island-like cathode conductors, to thereby form each of group units. In FIG. 2, the emitter cones 6 constituting one such group unit are arranged on each of island-like cathode conductors 7. Thus, both the emitter cones 6 arranged in proximity to the cathode wiring 2 and those arranged apart therefrom are permitted to have a resistance value kept substantially uniform, because the conductor-free area 8 is formed into a uniform width and the resistance layer 3 is formed into a uniform thickness.

Figure 3:
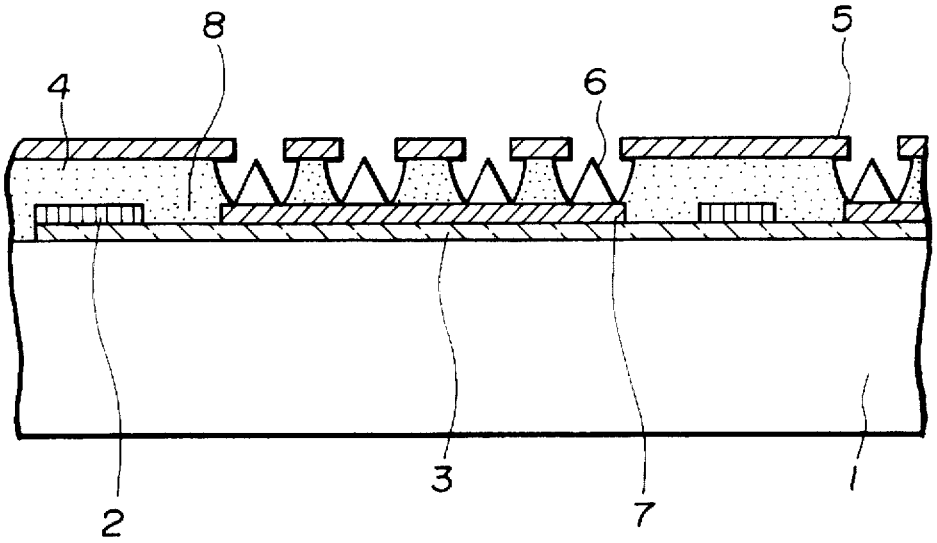
FIG. 3 is a sectional view showing a second embodiment of a field emission type electron source according to the present invention.

Referring now to FIG. 3, a cathode electrode incorporated in a second embodiment of a field emission type electron source according to the present invention is illustrated together with a cathode electrode incorporated therein. A field emission type electron source of the second embodiment is so constructed that a conductive section including a cathode wiring 2 and island-like cathode conductors 7, and a resistance layer 3 are positioned in a manner contrary to those in the first embodiment described above.

The resistance layer 3 is formed on an insulating substrate 1 so as to be positioned in a region of the cathode wiring 2. Then, the resistance layer 3 is provided thereon with the cathode wiring 2 and island-like cathode conductors 7. Also, the field emission type electron source includes an insulating layer 4 made of $SiO_2$ and a gate electrode 5 made of Nb, Mo, Al, $WSi_2$ or the like, which are formed on both each of the cathode wirings 2 and the island-like cathode conductors 7 in order. The gate electrode 5 and insulating layer 4 are formed with through-holes or apertures in a manner to be common to both, in which emitter cones 6 made of Mo are arranged, respectively.

The field emission type electron source of the second embodiment may be modified in such a manner that only the cathode wiring 2 is arranged on the insulating substrate 1 and the resistance layer 3 is formed all over the cathode wiring 2, followed by arrangement of the island-like cathode conductors 7 on the resistance layer 3. The emitter cones 6, insulating layer 4 and gate electrode 5 are provided on the island cathode conductors 7 as in the second embodiment described above.

Figure 4:
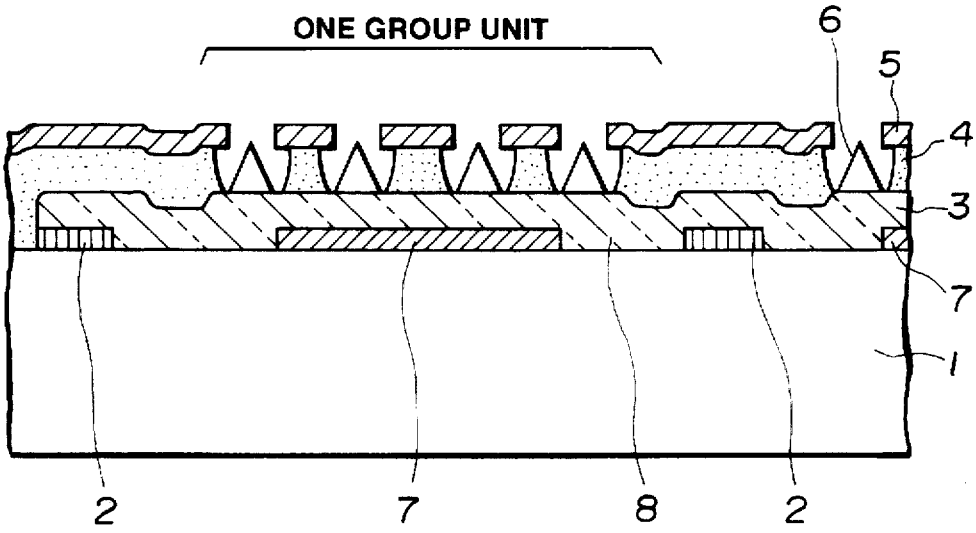
FIG. 4 is a sectional view showing a modification of the field emission type electron source of FIG. 3.

The first embodiment described above may be modified in such a manner as shown in FIG. 4. More particularly, a field emission type electron source of the modification is so constructed that emitter cones 6 are arranged between island-like cathode conductors 7 and a cathode-wiring 2. Such construction permits a resistance value of an emitter cone 6 nearest the cathode wiring 2 to be substantially determined by a length of a portion of a resistance layer 3 between the cathode wiring 2 and the emitter cone 6 and a resistance value of the remaining emitter cones 6 to be substantially determined depending on a length of a portion of the resistance layer 3 between the cathode wiring 2 and the island cathode conductors 7 and a thickness of the resistance layer 3 which defines an interval between the island-like cathode conductors 7 and the emitter cones 6. In view of such a situation, when a size of the island-like cathode conductors 7 is adjusted so as to render a resistance value of all the emitter cones 6 substantially constant, a resistance value of all the emitter cones 6 may be kept substantially constant or equal. In the modification shown in FIG. 4, of the emitter cones 6 constituting each of group units, emitter cones 6 other than those positioned outside the island-like cathode conductor 7 are positioned on the island-like cathode conductor.

Examples of arrangement of the emitter cone group unit with respect to the island-like cathode conductor 7 will be described hereinafter with reference to FIGS. 5(*a*) to 6, in which an insulating layer 4 and a gate electrode layer 5 are eliminated for the sake of brevity.

Figure 5A:
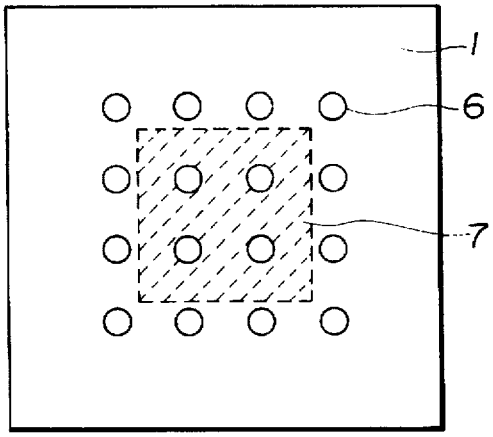
FIGS. 5(*a*) and 5(*b*) each are a schematic view showing an example of a size of an island-like cathode conductor.
Figure 5B:
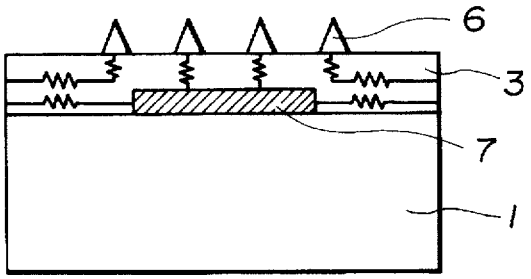

In an example shown in FIGS. 5(*a*) and 5(*b*), a group unit comprising sixteen emitter cones 6 is arranged, wherein twelve emitter cones 6 are arranged along an outer periphery of the the cathode wiring 2 and four emitter cones 6 are arranged in proximity to a central portion of the cathode wiring 2. Such arrangement causes the latter four emitter cones 6 to be increased in resistance value, so that an island-like cathode conductor 7 is arranged so as to cover the four emitter cones as indicated at broken lines near the central portion of the cathode wiring. This results in the four emitter cones 6 having a resistance value determined through the island-like cathode conductor 7, so that the resistance value of the four emitter cones 6 is decreased to a level substantially equal to a resistance value of the remaining emitter cones 6.

Figure 6:
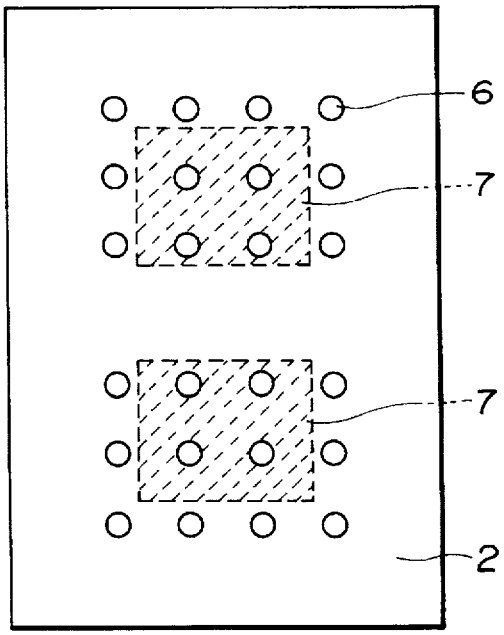
FIG. 6 is a schematic view showing another example of a size of an island-like cathode conductor.

In an example shown in FIG. 6, two group units each comprising twelve emitter cones 6 are arranged, wherein sixteen emitter cones are arranged along an outer periphery of the cathode wiring 2 and eight emitter cones 6 are arranged in proximity to a central portion of the cathode wiring 2 in a manner to extend in two rows in a longitudinal direction of the cathode wiring. Such arrangement of the emitter cones causes the latter eight central emitter cones to be increased in resistance value. Thus, two island-like cathode conductors 7 each are arranged so as to cover the four central emitter cones of each of the two group units, as indicated at broken lines in FIG. 6. This results in a resistance value of the latter each four central cone emitters 6 being determined through each of the island-like cathode conductors 7, so that the resistance value is decreased to a level substantially equal to a resistance value of the remaining emitter cones.

A resistance of each of the island-like cathode conductors 7 arranged for every group unit is set to be a higher level and in an electrically independent manner. The group units may be arranged so as to correspond to picture cells of a display, respectively.

Thus, it will be noted that the field emission type electron source of each of the above-described embodiments permits a size of the island-like cathode conductor 7 to be varied depending on the number of emitter cones constituting each group unit, so that the emitter cones of the same group unit each have a substantially constant or equal resistance value. This permits emission of electrons from all the emitter cones of the same group unit to be rendered substantially uniform and an emission current to be increased.

Also, the field emission type electron source of each of the embodiments permits mask alignment of the through-holes or apertures formed at a portion of the gate electrode 5 corresponding to the island-like cathode conductor 7 to be accomplished with accuracy decreased as compared with the prior art and the resistance layer 3 to be formed into a shape elongated in a lateral direction, resulting in exhibiting an increased resistance value.

Further, the field emission type electron source decreases a deviation between the emitter cones of the same group unit, to thereby increase the number of emitter cones to be arranged for each group unit. This eliminates a necessity of dividing the group unit into subunits, to thereby increase packaging density of the emitter cones and facilitate manufacturing of the electron source.

Moreover, in each of the above-described embodiments, a resistance value of each of the emitter cones is substantially determined depending on accuracy of a mask layer for the cathode wiring and island-like cathode conductors and a resistance value of the resistance layer. Also, the cathode wiring and island-like cathode conductors may be concurrently formed by means of the same mask. Thus, the above-described embodiments each permit a resistance value to be uniformly set all over the substrate while exhibiting satisfactory reproducibility.

Arrangement of an phosphor-deposited anode electrode in a manner to be spaced from the field emission type electron source leads to a display, wherein the groups units described above may be arranged so as to correspond to picture cells of the display, respectively.

In each of the above-described embodiments, the cathode electrode for the field emission type electron source includes the island-like cathode conductors 7 arranged inside the cathode wiring 2 and each having the conductor-free area 8 formed therearound. Alternatively, the cathode electrode may be constructed in such a manner as shown in FIGS. 7 or 8.

Figure 7:
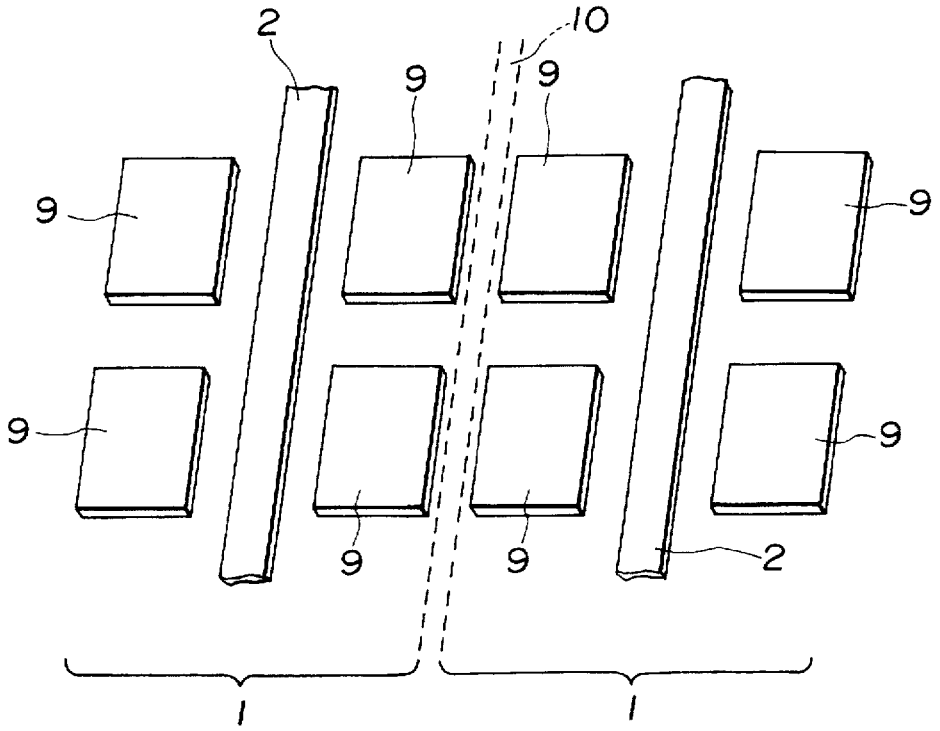
FIG. 7 is a perspective view showing another example of a cathode electrode incorporated in a field emission type electron source according to the present invention.

A cathode electrode shown in FIG. 7 is so constructed that each one region is defined by a strip-like cathode wiring 2 and a plurality of cathode conductors 9 arranged on both sides of the cathode wiring 2. The cathode wiring 2 and cathode conductors 9 of each region are connected to each other through a resistance layer. The resistance layer is arranged for every region and a resistance layer separation section 10 is provided between each adjacent two regions. Such construction may be accomplished by forming the cathode wiring 2 and cathode conductors 9 on each of the resistance layers and then arranging a plurality of emitter cones and a gate electrode on the cathode conductors 9 or by forming the resistance layer on the cathode wiring 2 and cathode conductors 9 and then forming a plurality of the emitter cones and a gate electrode on portions of the resistance layer corresponding the cathode conductors 9. Alternatively, the resistance layer may be arranged on the cathode wiring 2, followed by arrangement of the cathode conductors 9 on which a plurality of the emitter cones and the gate electrode are arranged on the resistance layer.

Figure 8:
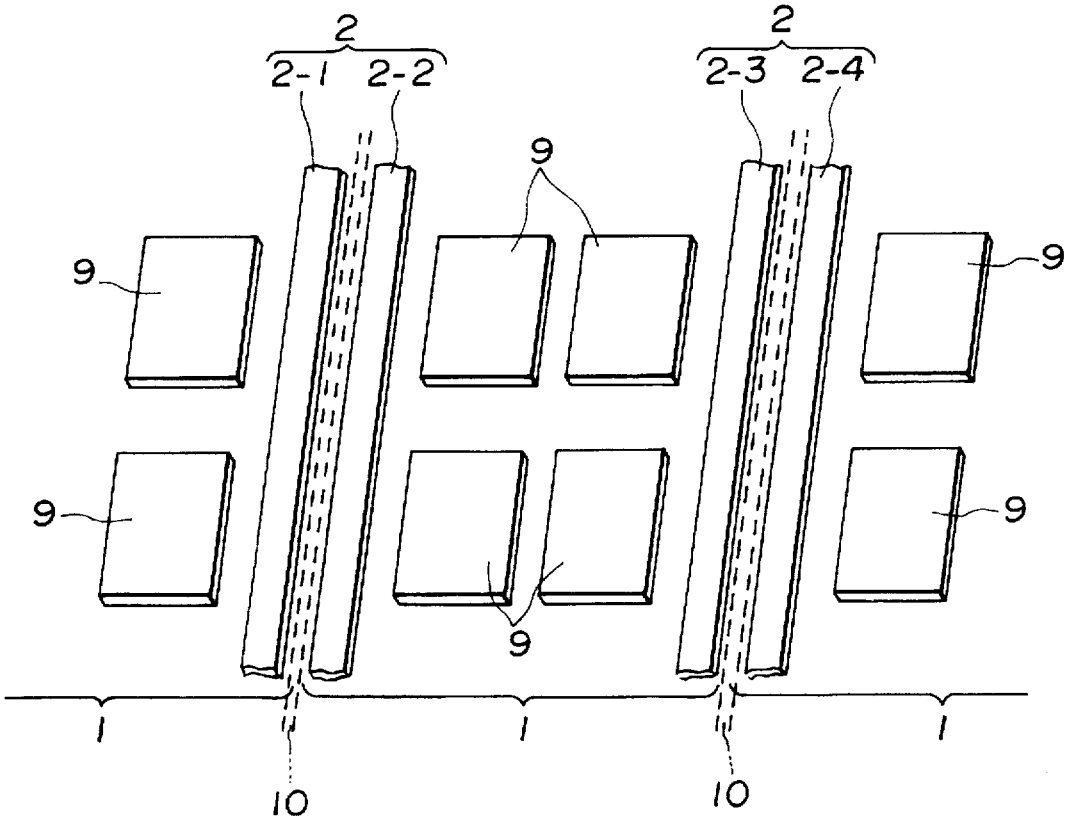
FIG. 8 is a perspective view showing a further example of a cathode electrode incorporated in a field emission type electron source according to the present invention.

A cathode electrode shown in FIG. 8 is so constructed that regions are defined by strip-like cathode wirings 2-1, 2-2, 2-3 and 2-4 and a plurality of cathode conductors 9 arranged between the cathode wirings. More particularly, one region is defined by cathode wirings 2-2 and 2-3 and cathode conductors 9 arranged between the cathode wirings. The cathode wiring 2-1 and cathode conductors of each region are connected to each other through a resistance layer. Likewise, resistance layers are used for connection of the cathode wirings 2-2 and 2-3 and cathode conductors 9 of each region and connection of the cathode wiring 2-4 and cathode conductors 9 of each region, respectively. Such construction may be accomplished by forming the cathode wirings 2-1 to 2-4 and cathode conductors 9 on the resistance layer and forming a plurality of emitter cones and a gate electrode on each of the cathode conductors 9 or by forming the resistance layer on the cathode wirings 2-1 to 2-4 and cathode conductors 9 and forming a plurality of the emitter cones and the cathode wiring on a portion of the resistance layer corresponding to each of the cathode conductors 9. Alternatively, this may be accomplished by forming the resistance layer on the cathode wirings 2-1 to 2-4 and forming, on the resistance layer, the cathode conductors 9 each provided thereon with a plurality of emitter cones and the gate electrode.

Now, manufacturing of the field emission type electron source shown in each of FIGS. 2 and 4 will be described.

First, the cathode wiring 2 made of a thin film of Nb, Mo, Al or the like is formed on the insulating substrate 1 made of glass or the like. Then, a scooped-out portion for each of the conductor-free areas 8 is formed on the cathode wiring 2 by photolithography. Concurrently, the island-like cathode conductors 7 each are formed inside the scooped-out portion by photolithography. The island-like cathode conductor 7 is not limited to a rectangular shape. It may be formed into any other suitable shape such as a circular shape or the like depending on arrangement of the emitter cones.

Next, the resistance layer 3 is formed into a film thickness of about 0.5 to 2.0 microns by sputtering or CVD techniques so as to cover the cathode wiring 2 and island-like conductors 7. The resistance layer may be made of a material such as amorphous silicone, $In_2O_3$, $Fe_2O_3$, ZnO, Ni-Cr alloy, silicon doped with any desired impurity or the like and a resisitivity of the resistance layer 3 is set to be about $1\times10^1$ to $1\times10^6$ cm.

Then, the insulating layer 4 is formed on the substrate 1 so as to cover the cathode, wiring 2 and resistance layer 3 by sputtering or CVD techniques. The insulating layer 4 is formed of silicon dioxide ($SiO_2$) into a film thickness of about 1.0 micron. Subsequently, the gate electrode 5 is arranged in the form of a film of about 0.4 micron in thickness on the insulating layer 4 by sputtering. The gate electrode 5 is made of Nb, Mo, Al, $WSi_2$ or the like. Next, the gate electrode 5 is formed with a plurality of through-holes or apertures of about 1.0 micron in diameter by photolithography, and then wet etching using buffered hydrogen fluoride (BHF) or the like or RIE using gas such as $CHF_3$ or the like is carried out through the apertures, to thereby permit the apertures to extend to the resistance layer 3.

Subsequently, aluminum is deposited in an oblique direction on the gate electrode 5 by electron beam (EB), to thereby form a release layer thereon. Next, positive deposition of Mo is carried out in a vertical direction on the release layer by EB deposition techniques, so that Mo is depositedly formed into a conical shape in each of the apertures, resulting in the emitter cones 6 being formed.

Thereafter, the release layer is removed by dissolution by means of a releasing solution such as a phosphoric acid or the like, resulting in the field emission type electron source shown in FIG. 2 or 4 being provided.

Now, manufacturing of the field emission type electron source shown in FIG. 3 will be described hereinafter.

First, the resistance layer 3 is formed of amorphous silicon, silicon doped with any desired impurity or the like into a film thickness of about 0.5 to 2.0 microns on the insulating substrate 1 made of glass, ceramic or the like by sputtering, CVD techniques or the like so as to extend over the cathode wiring 2. The resistance layer 3 preferably has a resistivity set within a range of $1\times10^1$ to $1\times10^6$ cm.

Next, a metal film of Nb, Mo, Al or the like is deposited on the resistance layer 3 so as to cover the resistance layer 3 and then subject to etching by photolithography, resulting in the conductor-free regions 8 being formed, resulting in the cathode wiring 2 and island-like cathode conductors 7 being separated from each other through the regions 8. Then, the insulating layer 4 made of silicon dioxide is formed into a thickness of about 1 micron on the cathode wiring 2 and island-like cathode conductors 7 by sputtering or CVD techniques. Thereafter, the gate electrode 5 is formed of Nb, Mo, Al, $WSi_2$ or the like into a thickness of about 0.4 micron on the insulating layer 4 by sputtering.

Then, the gate electrode 5 is formed with a plurality of the through-holes or apertures of about 1 micron in diameter by photolithography and then wet etching or RIE is carried out through the apertures, to thereby permit the apertures to extend to the island-like cathode conductors 7.

Thereafter, a release layer is arranged on the gate electrode 5 and then positive deposition of Mo is carried out on the release layer, resulting in the emitter cones 6 being formed according to such a procedure as described above.

Figure 9:
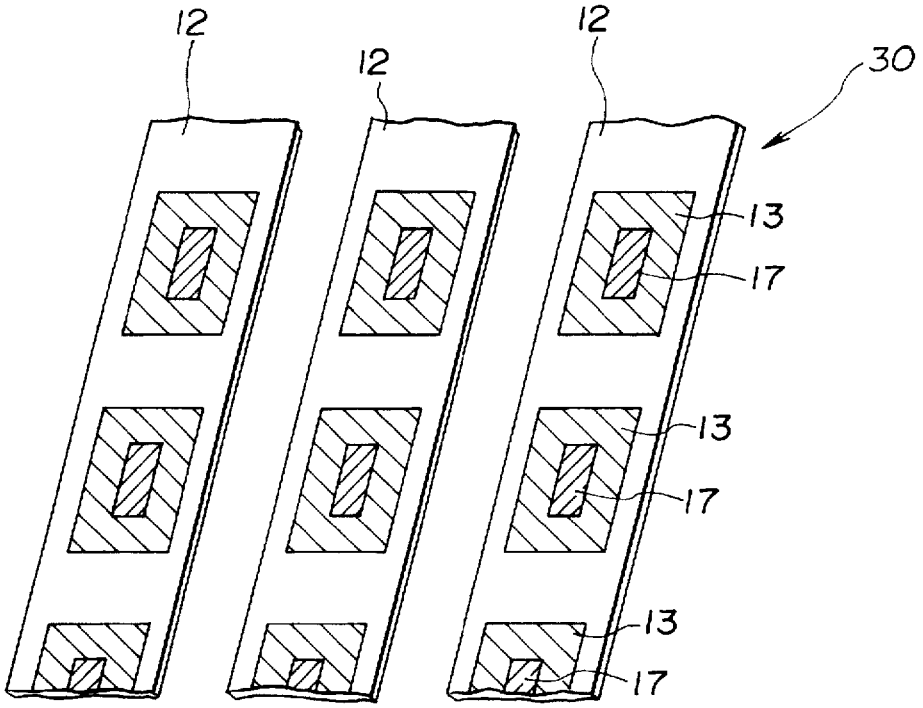
FIG. 9 is a perspective view showing a cathode electrode incorporated in a third embodiment of a field emission type electron source according to the present invention.

Referring now to FIG. 9, a cathode electrode incorporated in a third embodiment of a field emission type electron source according to the present invention is illustrated.

Figure 10:
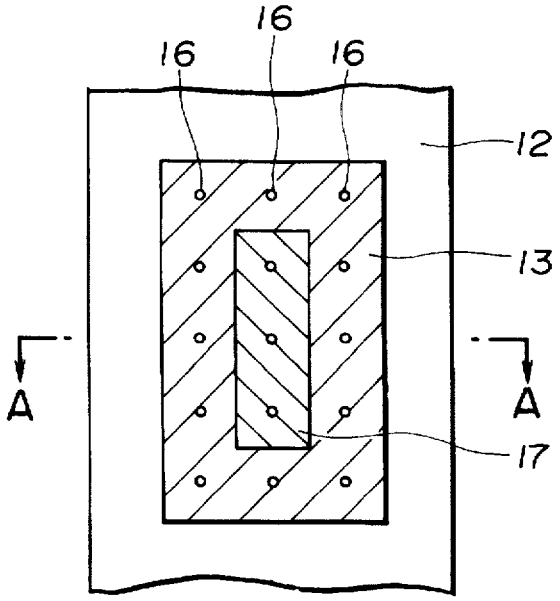
FIG. 10 is a plan view of the cathode electrode shown in FIG. 9.

A cathode electrode generally designated at reference numeral 30 in FIG. 9 includes a plurality of strip-like cathode wirings 12 arranged in juxtaposition to each other. The cathode wirings 12 each are formed with conductor-free areas in a window-like manner by scooping out a part of the cathode wiring. The window-like conductor-free areas each have first and second resistance layers 13 and 17 arranged therein. The second resistance layer 17 is positioned at a central portion of the window and the first resistance layer 13 is provided so as to surround the second resistance layer 17. A resistance value of the second resistance layer 17 is set at a level lower than that of the first resistance layer 13. FIG. 10 enlargedly shows the cathode wiring 12 thus scooped out, wherein the first resistance layer 13 and second resistance layer 17 are formed thereon with a plurality of emitter cones 16, resulting in an electron emission source being provided.

The emitter cones 16 formed on the first resistance layer 13 each are fed with an electric current from the cathode wiring 12 through the first resistance layer 13 and the emitter cones 16 formed on the second resistance layer 17 each function to feed an electric current therefrom through the first and second resistance layers 13 and 17 to the cathode electrode 12.

Figure 11:
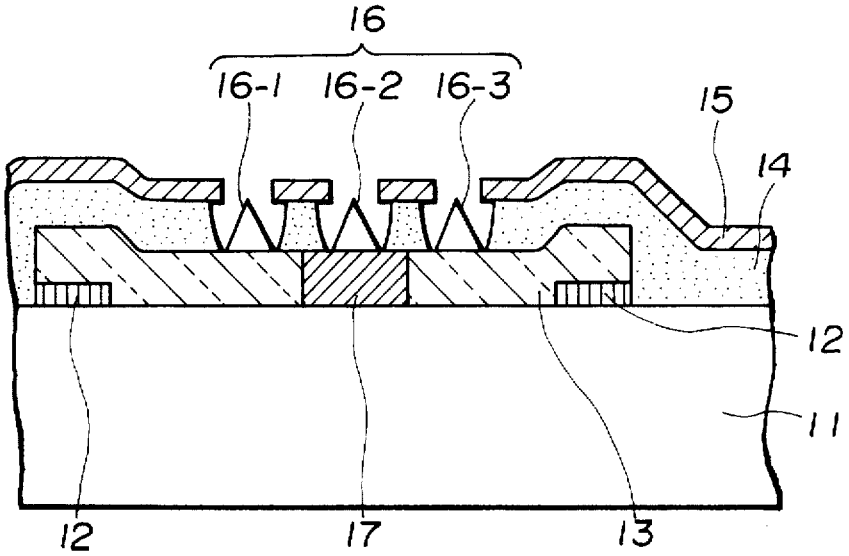
FIG. 11 is a sectional view showing a third embodiment of a field emission type electron source according to the present invention in which the cathode electrode shown in FIGS. 9 and 10 is incorporated.

FIG. 11 is a sectional view taken along line A—A of FIG. 10. The cathode wirings 12 are made of a thin conductive film of Nb, Mo, Al or the like and formed in a predetermined pattern on an insulating substrate 11. The cathode wirings 12 each are formed thereon with the first resistance layer 13 and second resistance layer 17 so as to extend all over a region of the cathode wiring 12. The resistance layers are made of amorphous silicon doped with any desired impurity or the like. Also, the first and second resistance layers 13 and 17 of each of the cathode wirings 12 are formed thereon with an insulating layer 14 and a gate electrode 15 of Nb, Mo or the like in order. The gate electrode 15 and insulating layer 14 are formed with a plurality of through-holes or apertures in a manner to be common to both, in which the emitter cones 16 of Mo are arranged, respectively. The gate electrodes 5 are formed into a stripe-like shape and form a matrix in cooperation with the cathode wirings 12.

Figure 12:
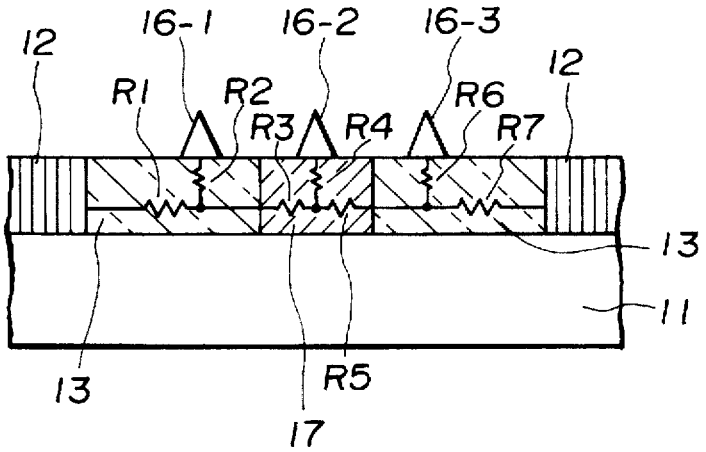
FIG. 12 is a circuit diagram showing an equivalent circuit of the filed emission type electron source of FIG. 11.

FIG. 12 shows an equivalent circuit of the field emission type electron source of FIG. 11, wherein emitter cones 6-1 and 6-3 are formed so as to be symmetric with each other, so that a resistance value between the emitter cone 16-1 and the cathode wiring 12 is equal to that between the emitter 16-3 and the cathode wiring 12. Also, a central emitter cone 6-2 is arranged so as to be spaced by an increased distance from the cathode wiring 12, resulting in a resistance value between the emitter cone 6-2 and the cathode wiring 12 being increased. Thus, when a resistance value of the second resistance layer 17 positioned below the emitter cone 16-2 is set at a low level, the emitter cone 16-2 is permitted to have a resistance value substantially equal to that of the remaining emitter cones 16-1 and 16-2.

Returning now to FIG. 10, the emitter cones 16 are arranged in three rows, wherein emitter cones 16 of the first and third rows and uppermost and lowermost emitter cones 16 of the second row are arranged on the first resistance layer 13 and three emitter cones 16 positioned at a center of the second row are arranged on the second resistance layer 17. As described above, the resistance value of the second resistance layer 17 is set to be lower than that of the first resistance layer 13, so that a resistance value between the cathode wiring 12 and the emitter cones of the first and third rows near the cathode wiring 12 and that between the cathode wiring 12 and the three emitter cones 16 at the center of the second resistance layer 17 are substantially equal to each other, because the second resistance layer 17 is decreased in resistance value.

Further, the embodiment may be constructed in such a manner that the first resistance layer 13 made of amorphous silicon doped with any desired impurity is formed all over the region of the cathode wiring 12 and then only a portion of the first resistance layer 13 corresponding to the second resistance layer is irradiated with laser or the like, to thereby be subject to annealing, resulting in the second resistance layer 17 being decreased in resistance value.

Now, a cathode electrode for a fourth embodiment of a field emission type electrode source according to the present invention will be described with reference to FIG. 13.

Figure 13:
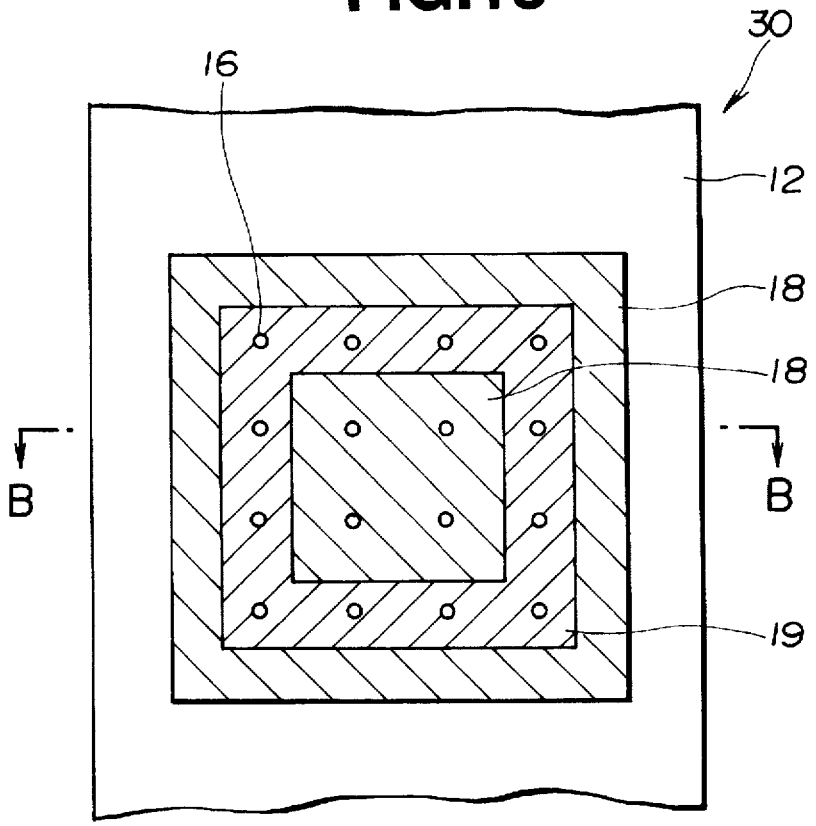
FIG. 13 is a plan view showing a cathode electrode for a fourth embodiment of field emission type electron source according to the present invention.

The cathode electrode shown in FIG. 13 is so constructed that a plurality of stripe-like cathode wirings 2 are arranged in juxtaposition to each other and the cathode wirings 2 each are formed with a window-like conductor-free area by scooping out a part thereof. The scooped-out window is provided therein with a first resistance layer 18 and a ring-like second resistance layer 19. The second resistance layer 19 is provided at a portion of the window near the cathode wiring 2 and has a resistance value set at a level higher than the first resistance layer 18. The first resistance layer 18 and second resistance layer 19 are provided thereon with a plurality of emitter cones 16 acting as an electron emission source. The emitter cones 16 arranged on the first resistance layer 18 are fed with an electric current from the cathode wiring 12 through the first and second resistance layers 18 and 19, and an electric current is fed from the emitter cones 16 arranged on the first resistance layer 18 through the first resistance layer 18 of an increased distance to the cathode wiring 12.

Figure 14:
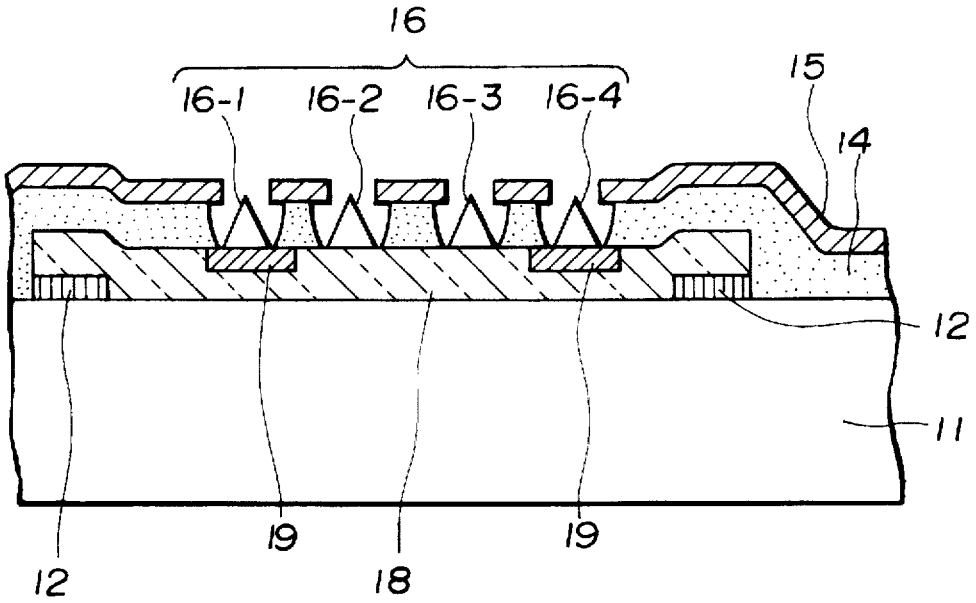
FIG. 14 is a sectional view showing a fourth embodiment of a field emission type electron source according to the present invention in which the cathode electrode shown in FIG. 13 is incorporated.

FIG. 14 is a sectional view taken along line B—B of FIG. 13. The cathode wirings 12 are made of a thin conductive film of Nb, Mo, Al or the like and formed in a predetermined pattern on an insulating substrate 11. The cathode wirings 12 each are formed thereon with the first resistance layer 18 and second resistance layer 19 so as to extend all over a region of the cathode wiring 12. The resistance layers are made of amorphous silicon doped with any desired impurity or the like. Also, the first and second resistance layers 18 and 19 of each of the cathode wirings 12 are formed thereon with an insulating layer 14 and a gate electrode 15 made of Nb, Mo or the like in order. The gate electrode 15 and insulating layer 14 are formed with a plurality of through-holes or apertures in a manner to be common to both, in which the emitter cones 16 of Mo are arranged, respectively. The gate electrodes 15 are formed into a stripe-like shape and form a matrix in cooperation with the cathode wirings 12.

The emitter cones 16 are arranged in four rows. The second resistance layer 19 is arranged under outer peripheral emitter cones 16 while being embedded by an intermediate depth from a surface of the first resistance layer 18 in the first resistance layer 18. FIG. 14, as described above, is a sectional view taken along line B—B of FIG. 13, so that the second resistance layer 19 is shown to be arranged below only the emitter cone 16-1 of the first row and the emitter cone 16-4 of the fourth row. The second resistance layer 19 has a resistance value set to be lower than that of the first resistance layer 18 and an increased distance is defined between the emitter cones 16-2 and 16-3 of the second and third rows and the cathode wiring 12, so that a resistance value between the cathode wiring 12 and each of the emitter cones 16-1 to 16-4 may be rendered substantially equal.

Also, the fourth embodiment may be constructed in such at manner that the second resistance layer 19 made of amorphous silicon doped with any desired impurity is arranged all over a region of the cathode wiring 12 and then the cathode wiring 12 is exposed at a portion thereof other than a portion thereof on which the second resistance layer 19 is formed to laser or the like upwardly projected through the transparent substrate, resulting in being partially subject to annealing. Then, the whole cathode wiring 12 is exposed to laser or the like upwardly projected through the substrate 11 for a short period of time, to thereby be subject to simple annealing, resulting in the first resistance layer being decreased in resistance value and the second resistance layer 19 being prevented from being decreased in resistance value and embedded by an intermediate depth from the surface of the first resistance layer 18 in the first resistance layer 18.

Figure 15:
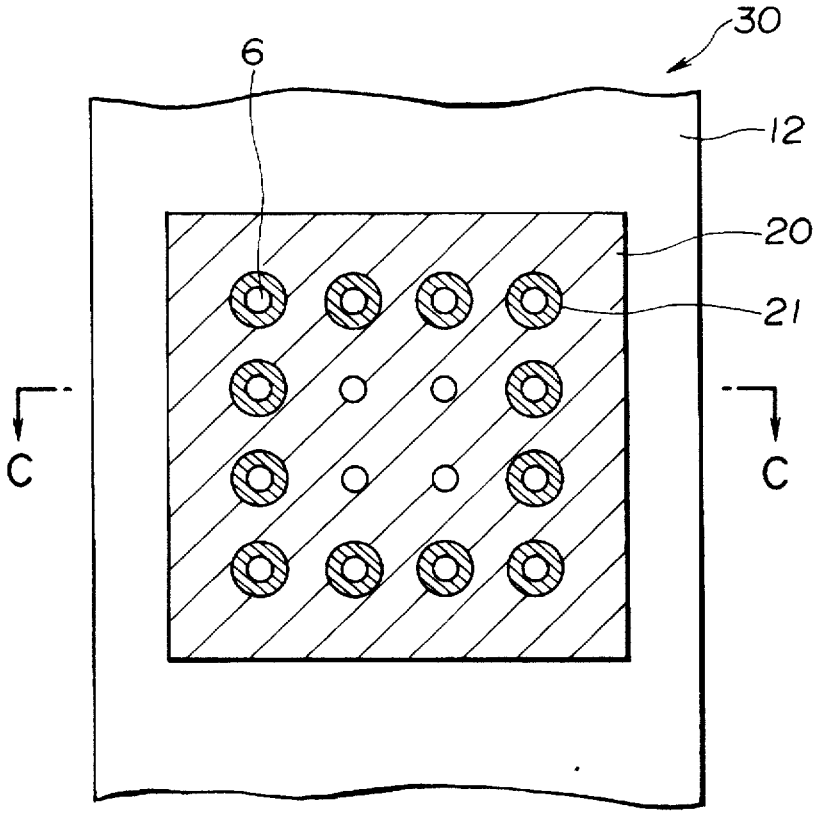
FIG. 15 is a plan view showing a cathode electrode for a fifth embodiment of a field emission type electron source according to the present invention.

Referring now to FIG. 15, a cathode electrode for a fifth embodiment of a field emission type electron source according to the present invention is illustrated. A cathode electrode 30 shown in FIG. 15 includes a plurality of stripe-like cathode wirings 12 arranged in juxtaposition to each other as in the cathode electrode described above with reference to FIG. 1. The cathode wirings 12 each are formed in a region thereof with a window-like conductor-free area by scooping out a part of the conductor wiring 12. The window-like area of the cathode wiring 12 is provided therein a first resistance layer 20 and second resistance layers 21. The second resistance layers 21 are positioned below only predetermined emitter cones 16. More particularly, the second resistance layers 21 are arranged under only emitter cones 16 formed in proximity to the cathode wiring 12 and have a resistance value set to be higher than that of the first resistance layer 20. A plurality of the emitter cones 16 formed on the first and second resistance layers 20 and 21 cooperate with each other to constitute an electron emission source. Of the emitter cones 16, those arranged on the second resistance layers 21 permit an electric current to flow therefrom through the first and second resistance layers 20 and 21 to the cathode wiring 12 and those arranged on the first resistance layer 20 permit an electric current to flow therefrom through the first resistance layer 20 of an increased distance to the cathode wiring 12.

Figure 16:
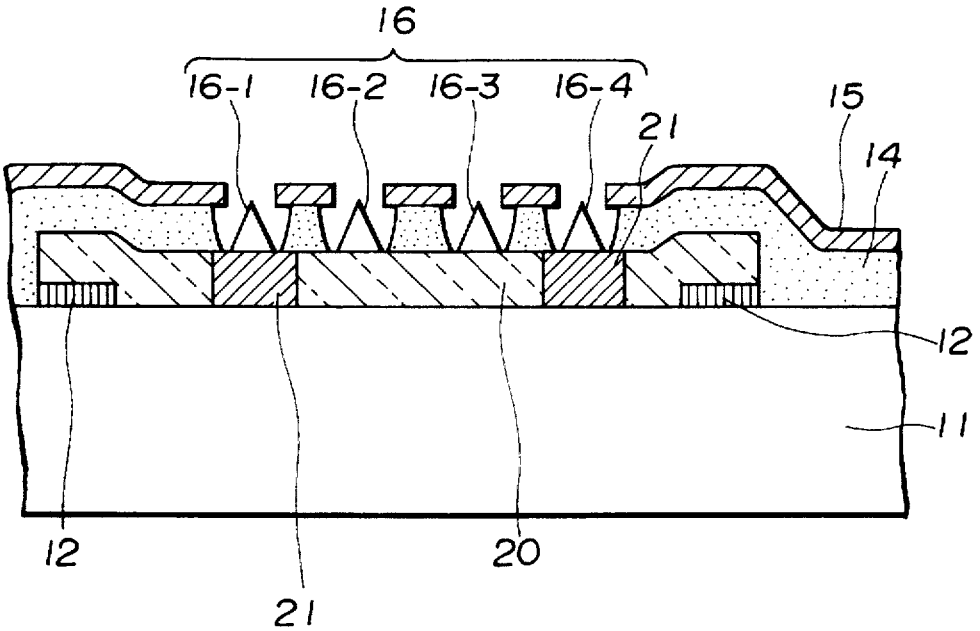
FIG. 16 is a sectional view showing a fifth embodiment of a field emission type electron source according to the present invention which has the cathode electrode of FIG. 15 incorporated therein.

FIG. 16 is a sectional view taken along line C—C of FIG. 15. The cathode wirings 12 are made of a thin conductive film of Nb, Mo, Al or the like and, as shown in FIG. 16, are arranged in a predetermined pattern on an insulating substrate 11. The above-described first and second resistance layers 20 and 21 are arranged on the cathode wiring 12 in a manner to cover a whole region of the cathode electrode 12. The resistance layers 20 and 21 may be made of a thin conductive film of Nb, Mo, Al or the like. An insulating layer 14 made of silicon dioxide ($SiO_2$) and a gate electrode 15 made of Nb, Mo or the like are arranged on the first and second resistance layers 20 and 21 of each of the cathode wirings 12. The gate electrode 15 and insulating layer 14 are formed with through-holes or apertures in a manner to be common to both, in which the emitter cones 16 made of Mo are arranged, respectively. The gate electrodes 15 are formed into a stripe-like shape and form a matrix in cooperation with the cathode wirings 12.

The emitter cones 16 are arranged in four rows. The second resistance layers 21 are arranged around a position immediately under outer peripheral emitter cones 16. FIG. 16, as described above, is a sectional view taken along line C—C of FIG. 15, so that the second resistance layers 21 are shown to be arranged below only the emitter cone 16-1 of the first row and the emitter cone 16-4 of the fourth row. The second resistance layers 21 each have a resistance value set to be lower than that of the first resistance layer 18 and an increased distance is defined between the emitter cones 16-2 and 16-3 of the second and third rows and the cathode wiring 12, so that a resistance value between the cathode wiring 12 and each of the emitter cones 16-1 to 16-4 may be rendered substantially equal.

Also, the fifth embodiment may be constructed in such a manner that the second resistance layers 21 made of amorphous silicon doped with any desired impurity are arranged all over the region of the cathode wiring 12 and then the cathode wiring 12 is exposed at a portion thereof other than a portion thereof on which the second resistance layer 19 is formed to laser or the like upwardly projected through the transparent substrate 11, resulting in being partially subject to annealing, so that the first resistance layer may be decreased in resistance value and the second resistance layers 19 may be prevented from being decreased in resistance value are formed.

Figure 17:
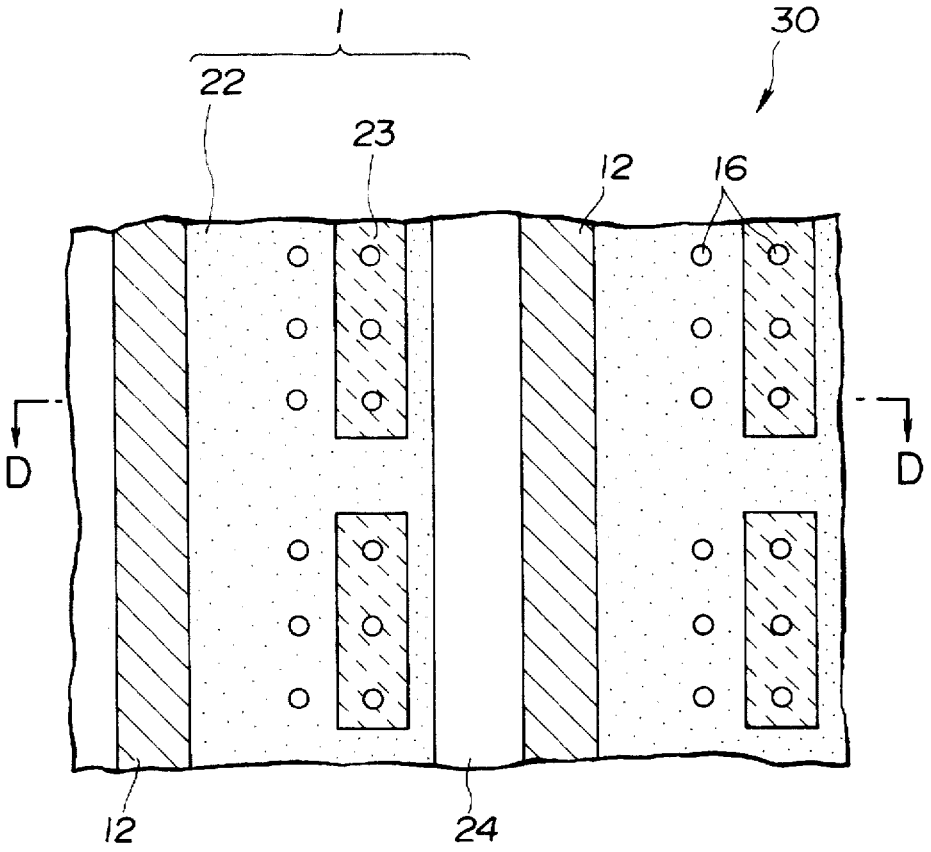
FIG. 17 Is a plan view showing a cathode electrode incorporated in a sixth embodiment of a field emission type electron source according to the present invention.

Referring now to FIG. 17, a cathode electrode for a sixth embodiment of a field emission type electron source according to the present invention is illustrated.

A cathode electrode generally designated at reference numeral 30 In FIG. 17 includes a plurality of a stripe-like cathode wirings 12. A region including each of the cathode wirings 12 is provided with a first resistance layer 22 and second resistance layers 23. The second resistance layers 23 are positioned below a part of emitter cones 16. Also, the second resistance layers 23 each are formed into an island-like shape and arranged under only emitter cones 16 provided apart from the cathode wiring 12. Further, the second resistance layers 23 each have a resistance value set to be lower than that of the first resistance layer 22. A plurality of emitter cones 16 arranged on the first and second resistance layers 22 and 23 constitute an electron emission source. Of the emitter cones 16, those arranged on the second resistance layers 23 permit an electric current to flow therefrom through the first and second resistance layers 22 and 23 to the cathode wiring 12 and those arranged on the first resistance layer 22 permit an electric current to flow therefrom through the first resistance layer 22 to the cathode wiring 12. Reference 24 designates a resistance layer separation section on which the first and second resistance layers 22 and 23 are not formed and which functions to accomplish electrical isolation between the stripe-like cathode wirings 12.

Figure 18:
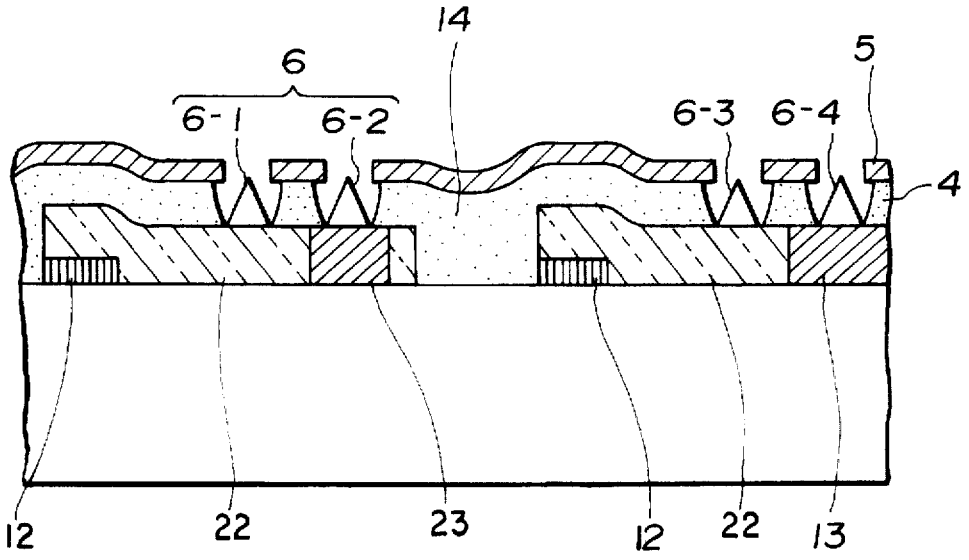
FIG. 18 is a sectional view showing a sixth embodiment of a field emission type electron source according to the present invention in which the cathode electrode shown in FIG. 17 is incorporated.

FIG. 18 is a sectional view taken along line D—D of FIG. 17. The cathode wirings 12 are made of a thin conductive film of Nb, Mo, Al or the like and, as shown in FIG. 18, are arranged in a predetermined pattern on an insulating substrate 11. The above-described first and second resistance layers 22 and 23 are arranged on the cathode wiring 12 in a manner to cover a whole region of the cathode electrode 30. The resistance layers 22 and 23 may be made of a thin conductive film of Nb, Mo, Al or the like. An insulating layer 14 made of silicon dioxide ($SiO_2$) and a gate electrode 15 made of Nb, Mo or the like are arranged on the first and second resistance layers 22 and 23 of each of the cathode wirings 12. The gate electrode 15 and insulating layer 14 are formed with through-holes or apertures in a manner to be common to both, in which the emitter cones made of Mo are arranged, respectively. The gate electrodes 15 are formed into a stripe-like shape and form a matrix in cooperation with the cathode wirings 12.

In the construction shown in FIG. 18, a resistance value of each of emitter cones 16-1 and 16-3 and the cathode wiring 12 is determined depending on a length of the first resistance layer 22. Also, emitter cones 16-2 and 16-4 are arranged so as to be spaced by an increased distance from the cathode wiring 12, so that a resistance value between the emitter cones and the cathode wiring 12 is generally increased. Thus, when the second resistance layers 23 positioned under the emitter cones 16-2 and 16-4 are formed so as to exhibit a decreased resistance, a resistance value of the emitter cones may be rendered substantially equal to that of the emitter cones 16-1 and 16-3.

More particularly, the emitter cones 16 are arranged in two rows in the region of each of the cathode wirings 12 as shown in FIGS. 17 and 18, wherein the emitter cones 16-1 and 16-3 of a first row are arranged on the first resistance layer 22 and the emitter cones 16-2 and 16-4 of a second row are arranged on the island-like second resistance layers 23. As described above, the resistance value of the second resistance layers 23 is set to be low as compared with that of the first resistance layer 22, so that a resistance value of the emitter cones 16-1 and 16-3 of the first row arranged in proximity to the cathode wiring 12 and that of the emitter cones 16-2 and 16-4 of the second row arranged apart from the cathode wiring 12 are rendered substantially equal to each other, because the second resistance layer 22 is decreased in resistance value.

In the sixth embodiment described above, the first and second resistance layers 22 and 23 are arranged on only one side of the cathode wiring 12. Alternatively, they may be arranged on either side of the cathode wiring 12. Also, the cathode wiring 12 is arranged directly on the substrate 11. Alternatively, it may be arranged on the first resistance layer 22.

The sixth embodiment may be so constructed that the first resistance layer 22 made of amorphous silicon doped with any desired impurity is arranged all over the region of the cathode wiring 12 and then the cathode wiring 12 is exposed at a portion thereof other than a portion thereof on which the second resistance layers 23 are formed to laser or the like, resulting in being partially subject to annealing, so that the second resistance layers may be decreased in resistance value.

Figure 19:
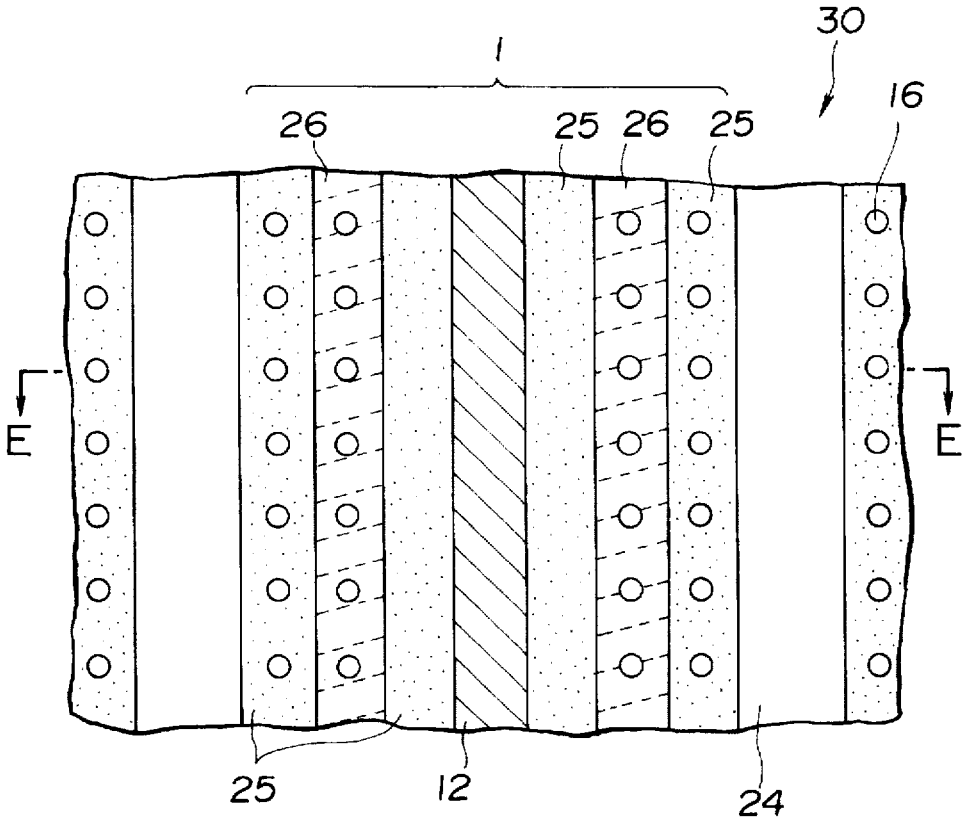
FIG. 19 is a plan view showing a cathode electrode for a seventh embodiment of a field emission type electron source according to the present invention.

Referring now to FIG. 19, a cathode electrode for a seventh embodiment of a field emission type electron source according to the present invention is illustrated.

A cathode electrode generally designated by reference numeral 30 in FIG. 19 includes a plurality of stripe-like cathode wirings 12 arranged in juxtaposition to each other. The cathode wirings 12 each have a region in which a first resistance layer 25 is arranged so as to extend in opposite directions from both sides of the cathode wiring 12 while straddling the cathode wiring 12. The cathode electrode 30 also includes second resistance layers 26 arranged in a manner to be embedded by an intermediate depth from a surface of the first resistance layer 25 in the first resistance layer on both sides of the cathode wiring 12 and positioned below emitter cones 16 provided in proximity to the cathode wiring 12. The second resistance layers 26 have a resistance value set to be higher than that of the first resistance layers 25. Emitter cones 16 are also arranged on a portion of the first resistance layer 25 defined outside the second resistance layers 26. Thus, the emitter cones 16 arranged on both first and second resistance layers 25 and 26 constitute an electron emission source. Of the emitter cones 16, those arranged on the second resistance layers 26 permit an electric current to flow therefrom through the first and second resistance layers 25 and 26 to the cathode wiring 12 and those arranged on the first resistance layer 26 permit an electric current to flow therefrom through the first resistance layer 26 of an increased distance to the cathode wiring 12.

Figure 20:
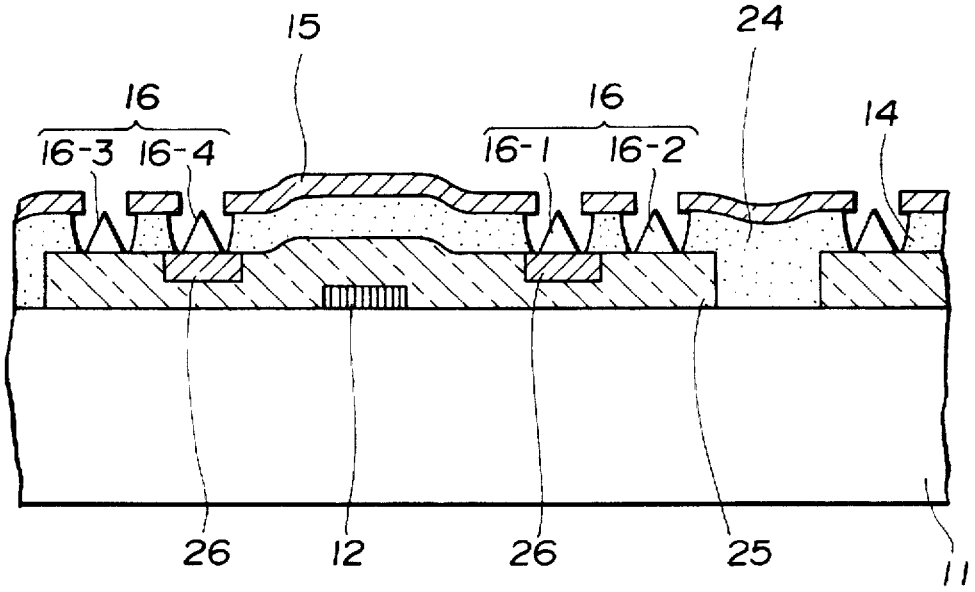
FIG. 20 is a sectional view showing a seventh embodiment of a field emission type electron source according to the present invention in which the cathode electrode shown in FIG. 19 is incorporated.

FIG. 20 is a sectional view taken along line E—E of FIG. 19. The cathode wirings 12 are made of a thin conductive film of Nb, Mo, Al or the like and, as shown in FIG. 20, are arranged in a predetermined pattern on an insulating substrate 11. The above-described first and second resistance layers 25 and 26 are arranged on each of the cathode wirings 12 in a manner to cover the whole region of the cathode wiring 12. The resistance layers 25 and 26 may be made of a thin conductive film of Nb, Mo, Al or the like. An insulating layer 14 made of silicon dioxide ($SiO_2$) and a gate electrode 15 made of Nb, Mo or the like are arranged on the first and second resistance layers 25 and 26 of each of the cathode wirings 12. The gate electrode 15 and insulating layer 14 are formed with through-holes or apertures in a manner to be common to both, in which the emitter cones 16 made of Mo are arranged, respectively. The gate electrodes 15 are formed into a stripe-like shape and form a matrix in cooperation with the cathode wirings 12.

The emitter cones 16, as shown in FIG. 19, are arranged in two rows on either side of the cathode wiring 12 and the second resistance layers 26 each are arranged under emitter cones 16-1 and 16-2 provided in proximity to the cathode wiring 12 on each side of the cathode wiring 12 in a manner to be embedded by an intermediate depth from a surface of the first resistance layer 25 in the first resistance layer 25. The second resistance layers 26 each have a resistance value set to be higher than that of the first resistance layer 25 and an increased distance is defined between the emitter cones 16-2 and 16-3 of the second row and the cathode wiring 12, so that a resistance value between the cathode wiring 12 and each of the emitter cones 16-1 to 16-4 may be rendered substantially equal.

Also, the seventh embodiment may be constructed in such a manner that the second resistance layers 26 made of amorphous silicon doped with any desired impurity are arranged all over the region of the cathode wiring 12 and then the cathode wiring 12 is exposed at a portion thereof other than a portion thereof on which the second resistance layers 26 are formed to laser or the like upwardly projected through the transparent substrate 11, resulting in being partially subject to annealing. Then, the whole cathode wiring 12 is exposed to laser or the like upwardly projected through the substrate 11 for a short period of time, to thereby be subject to simple annealing, resulting in the first resistance layer 25 being decreased in resistance value and the second resistance layers 26 being prevented from being decreased in resistance value and embedded by an intermediate depth from the surface of the first resistance layer 25 in the first resistance layer 25. Reference 24 designates a resistance layer separation section on which the first and second resistance layers 22 and 23 are not formed and which functions to accomplish electrical isolation between the stripe-like cathode wirings 12.

Figure 21:
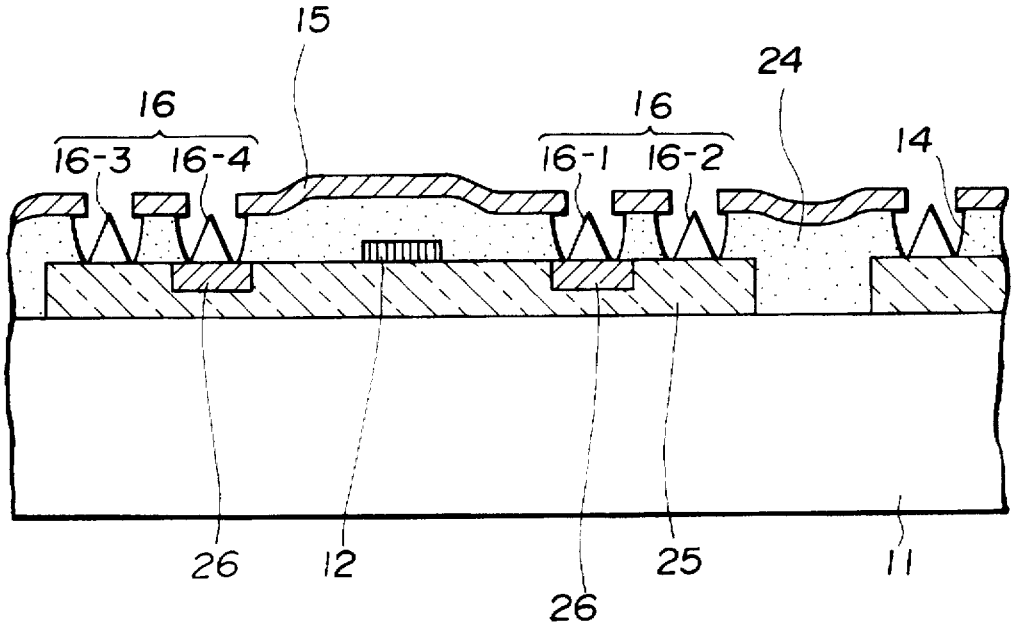
FIG. 21 is a sectional view showing a modification of the field emission type electron source of FIG. 20.

Also, in the seventh embodiment, the first and second resistance layers 25 and 26 are arranged on either side of the cathode wiring 12. Alternatively, the resistance layers 25 and 26 may be arranged on any one of both sides of the cathode wiring 12. Further, the cathode wiring 12 is arranged directly on the substrate 11. Alternatively, it may be arranged on the first resistance layer 22 as shown in FIG. 21.

Figure 22:
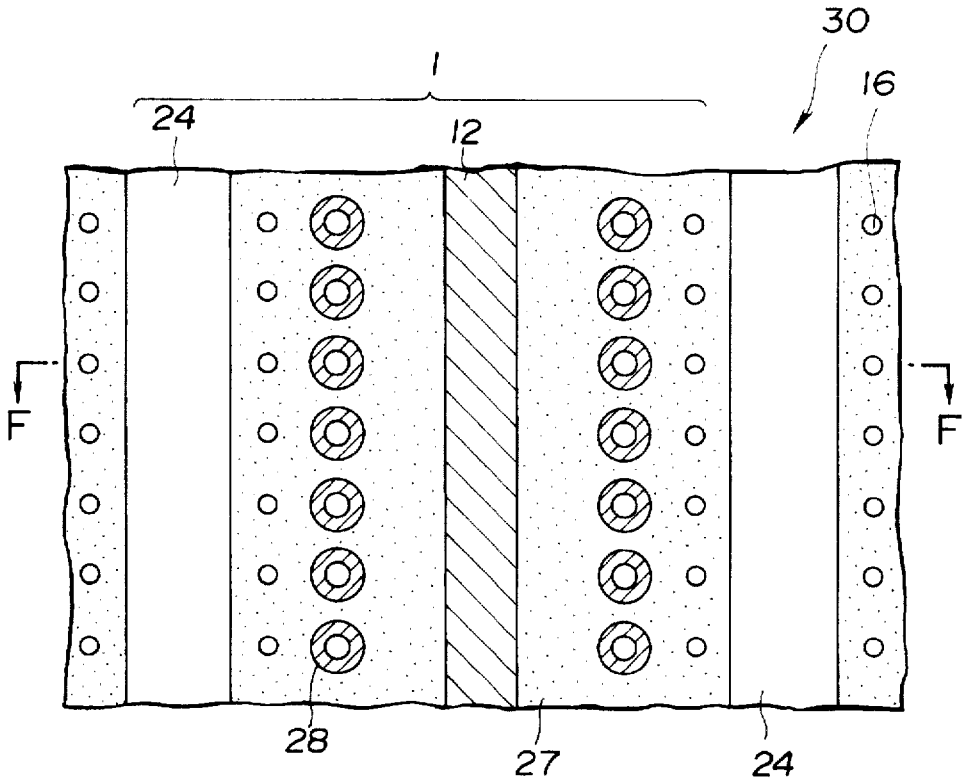
FIG. 22 is a plan view showing a cathode electrode for an eighth embodiment of a field emission type electron source according to the present invention.

Referring now to FIG. 22, a cathode electrode for an eighth embodiment of a field emission type electron source according to the present invention is illustrated.

A cathode electrode generally designated by reference numeral 30 in FIG. 22 includes a plurality of stripe-like cathode wirings 12 arranged in juxtaposition to each other. The cathode wirings 12 each have a region in which a first resistance layer 27 is arranged so as to extend in opposite directions from both sides of the cathode wiring 12 while straddling it. The cathode electrode 30 also includes second resistance layers 28 arranged in proximity to a position immediately under emitter cones 16 provided in proximity to the cathode wiring 12. The second resistance layers 28 have a resistance value set to be higher than that of the first resistance layers 27. Also, emitter cones 16 are arranged on a portion of the first resistance layer 27 defined outside the second resistance layers 28. Thus, the emitter cones 16 arranged on both first and second resistance layers 27 and 28 constitute an electron emission source. Of the emitter cones 16, those arranged on the second resistance layers 28 permit an electric current to flow therefrom through the first and second resistance layers 27 and 28 to the cathode wiring 12 and those arranged on the first resistance layer 27 permit an electric current to flow therefrom through the first resistance layer 27 of an increased distance to the cathode wiring 12.

Figure 23:
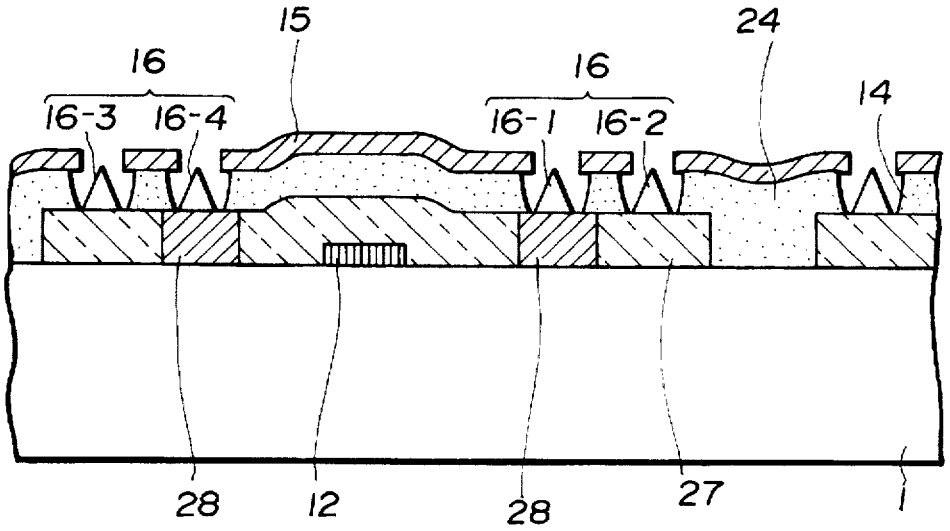
FIG. 23 is a sectional view showing an eighth embodiment of a field emission type electron source according to the present invention in which the cathode electrode shown in FIG. 22 is incorporated.

FIG. 23 is a sectional view taken along line F—F of FIG. 22. The cathode wirings 12 are made of a thin conductive film of Nb, Mo, Al or the like and, as shown In FIG. 23, are arranged in a predetermined pattern on an insulating substrate 11. The above-described first and second resistance layers 27 and 28 are arranged on each of the cathode wirings 12 in a manner to cover the whole region of the cathode wiring 12. The resistance layers may be made of a thin conductive film of Nb, Mo, Al or the like. An insulating layer 14 made of silicon dioxide ($SiO_2$) and a gate electrode 15 made of Nb, Mo or the like are arranged on the first and second resistance layers 27 and 28 of each of the cathode wirings 12. The gate electrode 15 and insulating layer 14 are formed with through-holes or apertures in a manner to be common to both, in which the emitter cones 16 made of Mo are arranged, respectively. The gate electrodes 15 are formed into a stripe-like shape and form a matrix in cooperation with the cathode wirings 12.

The emitter cones 16, as shown in FIG. 23, are arranged in two rows on either side of the cathode wiring 12 and the second resistance layers 28 each are arranged in proximity to a position immediately under emitter cones 16-1 and 16-4 provided in proximity to the cathode wiring 12 on each side of the cathode wiring 12. The second resistance layers 28 each have a resistance value set to be higher than that of the first resistance layer 27 and an increased distance is defined between the emitter cones 16-2 and 16-3 of a second row and the cathode wiring 12, so that a resistance value between the cathode wiring 12 and each of the emitter cones 16-1 to 16-4 may be rendered substantially equal.

Also, the eighth embodiment may be constructed in such a manner that the second resistance layers 28 made of amorphous silicon doped with any desired impurity are arranged all over the region of the cathode wiring 12 and then the cathode wiring 12 is exposed at a portion thereof other than a portion thereof on which the second resistance layers 28 are formed to laser or the like upwardly projected through the transparent substrate 11, resulting in being partially subject to annealing, so that the first resistance layer 27 is decreased in resistance value and the second resistance layers 28 is prevented from being decreased in resistance value. Reference 24 designates a resistance layer separation section on which the first and second resistance layers 22 and 23 are not formed and which functions to accomplish electrical isolation between the stripe-like cathode wirings 12.

Figure 24:
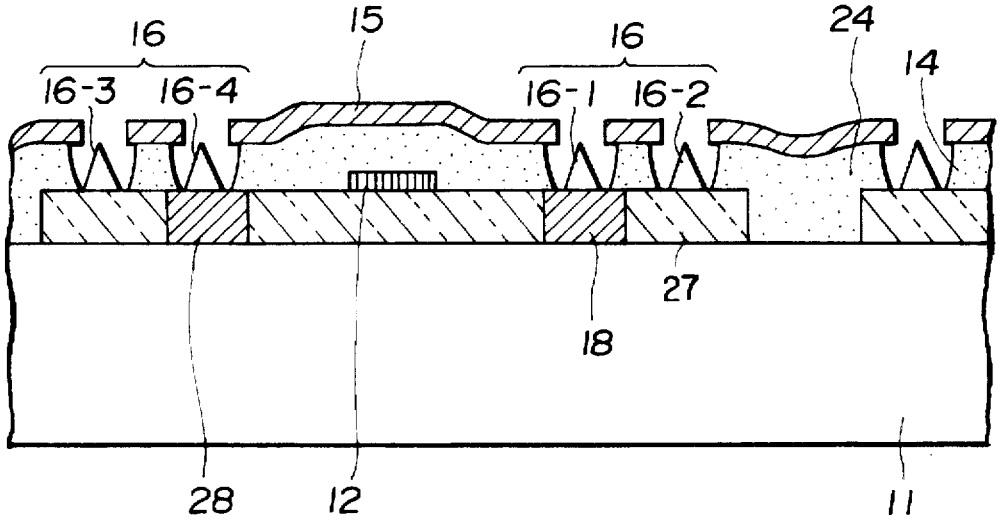
FIG. 24 is a sectional view showing a modification of the field emission type electron source shown in FIG. 23.
Figure 25A:
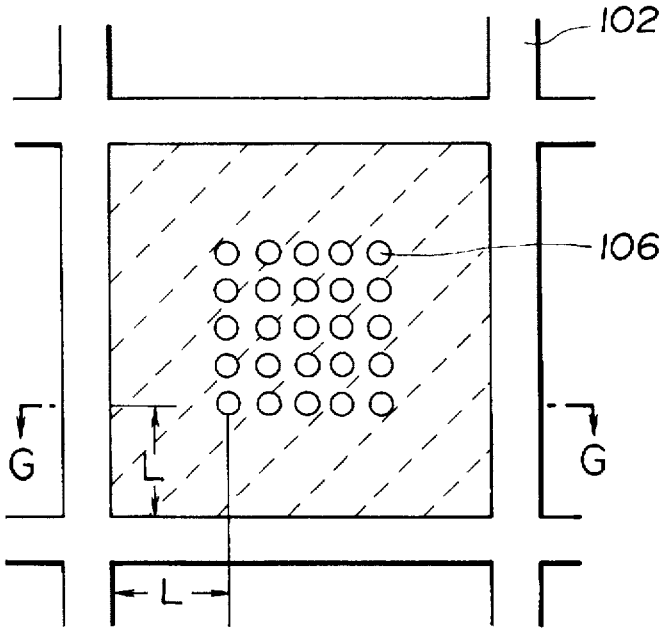
FIG.25(a) PRIOR ART
FIG. 25(*a*) is a plan view showing a conventional field emission type electron source.
Figure 25B:
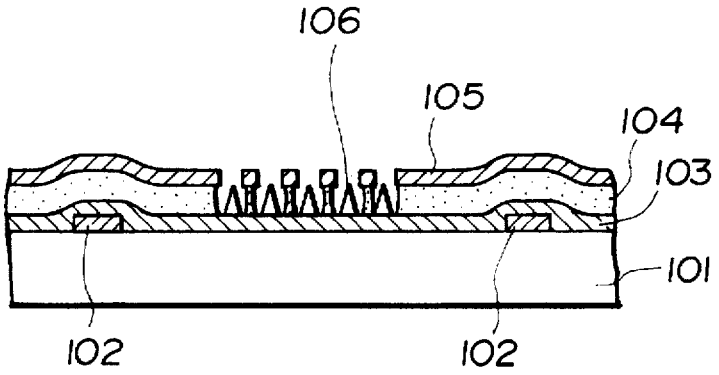
FIG.25(b) PRIOR ART

Also, in the eighth embodiment, the first and second resistance layers 27 and 28 are arranged on either side of the cathode wiring 12. Alternatively, the resistance layers may be arranged on any one of both sides of the cathode wiring 12. Further, the cathode wiring 12 is arranged directly on the substrate 11. Alternatively, it may be arranged on the first resistance layer 22 as shown in FIG. 24.

As can be seen from the foregoing, the field emission type electron source of the present invention permits the emitter cones arranged in the region of the cathode wiring 12 to have a substantially equal resistance value, resulting in all the emitter cones in the region exhibiting substantially the same electron emission and emission current being increased.

Also, the present invention minimizes a difference in resistance value between the emitter cones in the region of the cathode wiring 12, to thereby increase the number of emitter cones to be arranged in the region and facilitate manufacturing of the device of the present invention.

Arrangement of a phosphor-deposited anode electrode in a manner to be spaced from the field emission type electron source of the present invention provides a display, wherein the regions of the cathode wirings 12 are arranged so as to correspond to picture cells of the display, respectively.

In each of the third to eighth embodiments described above, the first and second resistance layers each may be made of amorphous silicon doped with any desired impurity, polysilicon or the like. The impurity to be doped in the material may be selected from the group consisting of P, Bi, Ga, In, Tl and the like, so that a resistance value of the resistance layers may be suitably adjusted within a range of $10^1$ to $10^6$ cm. This permits the second resistance layer 17 of the third embodiment, the first resistance layer 18 of the fourth embodiment, the first resistance layer 20 of the fifth embodiment, the second resistance layer 23 of the sixth embodiment, the first resistance layer 25 of the seventh embodiment and the first resistance layer 27 of the eighth embodiment to be decreased in resistance value.

Further, XeCl excimer laser (wavelength=308 nm) may be conveniently used for annealing in the present invention. A time length for irradiation of laser is about 0.1 second. Annealing may be carried out by means of a lamp in place of laser.

The present invention constructed as described above permits a resistance value between the cathode electrode and each of the emitter cones to be rendered constant, so that uniform emission of electrons from the emitter cones arranged in the cathode region may be ensured. Also, uniformity of emission of electrons from the emitter cones can be ensured even when the emitter cones are arranged in proximity to the cathode electrode, so that the number of emitter cones to be arranged in the region of the cathode may be increased, to thereby improve packaging density of the emitter cones.

While preferred embodiments of the invention have been have been described, obvious modifications and variations are possible in light of the above teachings. It is therefore to be understood that within the scope of the appended claims, the invention may be practiced otherwise.

What is claimed is:

1. A field emission electron source comprising:

a cathode wiring;

a resistance layer arranged in correspondence to said cathode wiring;

a plurality of cathode conductors arranged in a region of said cathode wiring in a manner to be separate from said cathode wiring, said cathode wiring and said cathode conductors being electrically connected to each other through said resistance layer; and emitters connected through said resistance layer to said cathode wiring, said emitters being formed into a conical shape and arranged directly or through said resistance layer on said cathode conductors.

2. A field emission electron source as defined in claim 1, further comprising an insulating substrate;

said cathode wiring and said cathode conductors being provided on said insulating layer.

3. A field emission electron source as defined in claim 1, further comprising an insulating substrate;

said resistance layer being arranged on said insulating substrate;

said cathode wiring and said cathode conductors being disposed on said resistance layer.

4. A field emission electron source as defined in any one of claims 1 to 3, wherein said cathode wiring is formed into a stripe shape;

said cathode conductors each are provided on a periphery thereof with a conductor-free area and formed into an island shape; and said cathode conductors are arranged inside said cathode wiring.

5. A field emission electron source as defined in claim 4, wherein at least one of said island cathode conductors is arranged so as to correspond to each of picture cells of a display.

6. A field emission type electron source comprising:

cathode wirings;

said cathode wirings each having a region provided therein with a conductor-free window;

a resistance layer being arranged in said window;

emitters formed into a conical shape and arranged on said resistance layer;

said resistance layer being so constructed that a resistance value of a central portion thereof is set to be lower than that of a peripheral portion thereof.

7. A field emission electron source comprising:

cathode wirings;

said cathode wirings each having a region provided therein with a conductor-free window;

a resistance layer provided in said window; and emitters formed into a conical shape and arranged on said resistance layer;

said emitters being arranged at a part thereof on an outer peripheral portion of said resistance layer;

said portion of said resistance layer on which said part of said emitters is arranged having a resistance value set to be high by an intermediate depth from a surface of said resistance layer.

8. A field emission electron source comprising:

cathode wirings;

said cathode wirings each having a region provided therein with a conductor-free window;

a resistance layer provided in said window; and emitters formed into a conical shape and arranged on said resistance layer;

said emitters being arranged at a part thereof on an outer peripheral portion of said resistance layer;

said resistance layer having a resistance value set to be high at a portion thereof in proximity to said part of said emitters.

9. A field emission electron source comprising:

an insulating substrate;

cathode wirings formed into a stripe shape and arranged on said insulating substrate;

a resistance layer arranged in a region which includes each of said cathode wirings and is defined on said insulating substrate; and emitters formed into a conical shape and arranged on said resistance layer;

said emitters being arranged at a part thereof in proximity to said cathode wiring;

a portion of said resistance layer on which said part of said emitters is arranged having a resistance value set to be high by an intermediate depth from a surface of said resistance layer.

10. A field emission electron source comprising:

an insulating substrate;

cathode wirings formed into a stripe shape and arranged on said insulating substrate;

a resistance layer arranged in a region which includes each of said cathode wirings and is defined on said insulating substrate; and emitters formed into a conical shape and arranged on said resistance layer;

said emitters being arranged at a part thereof in proximity to said cathode wiring;

said resistance layer having a resistance value set to be high at a portion thereof positioned under said part of said emitters.

11. A field emission electron source as defined in any one of claims 8 to 9, wherein said cathode wiring is formed on said resistance layer.

12. A field emission electron source as defined in any one of claims 8 and 10, wherein said cathode wiring is arranged on an transparent insulating substrate.

13. A field emission electron source as defined in any one of claims 8 and 10, wherein said resistance layer is subject at a part thereof to annealing, resulting in being provided with a decreased resistance section.

14. A field emission type electron source as defined in any one of claims 6 to 8, wherein said cathode wiring is provided with at least one window, which is arranged so as to correspond to each of picture cells of a display.

* * * * *